US007128659B1

(12) United States Patent
Lee

(10) Patent No.: US 7,128,659 B1
(45) Date of Patent: Oct. 31, 2006

(54) GOLF CLUB SHAFT MADE OF FIBER COMPOSITE MATERIAL AND METAL MATERIAL

(76) Inventor: Ming-Hsien Lee, P.O. Box 453, Taichung (TW)

( * ) Notice: Subject to any disclaimer, the term of this patent is extended or adjusted under 35 U.S.C. 154(b) by 547 days.

(21) Appl. No.: 10/687,105

(22) Filed: Oct. 17, 2003

(51) Int. Cl.
*A63B 53/10* (2006.01)
*A63B 53/12* (2006.01)

(52) U.S. Cl. ..... 473/316; 473/320

(58) Field of Classification Search ..... 473/316–323
See application file for complete search history.

(56) References Cited

U.S. PATENT DOCUMENTS 2,379,006 A * 6/1945 Johnson ..... 473/568
3,873,090 A * 3/1975 Thompson ..... 473/312
4,470,600 A * 9/1984 Parente et al. ..... 473/308
5,253,867 A * 10/1993 Gafner ..... 473/320
6,129,962 A * 10/2000 Quigley et al. ..... 428/36.1
6,582,320 B1 * 6/2003 Fendel ..... 473/312
6,793,590 B1 * 9/2004 Ho ..... 473/320

FOREIGN PATENT DOCUMENTS

JP 8-3336 * 1/1996

* cited by examiner

*Primary Examiner*—Stephen Blau
(74) *Attorney, Agent, or Firm*—Egbert Law Offices

(57) ABSTRACT

A golf club shaft is formed of an upper segment of a fiber composite material, a lower segment of a metal material, a joint connecting the upper segment and the lower segment, and a sheath of a woody material for covering the upper segment, the lower segment, and the joint.

4 Claims, 5 Drawing Sheets

GOLF CLUB SHAFT MADE OF FIBER COMPOSITE MATERIAL AND METAL MATERIAL

BACKGROUND OF THE INVENTION

1. Field of the Invention

The present invention relates generally to golf club, and more particularly to a shaft of the golf club, which is formed of an upper segment of a fiber composite material, and a lower segment of a metal material.

2. Description of Related Art

The conventional golf club shaft is generally made of a metal material or carbon fiber material. The metal shaft has an excellent torsional force and a relatively poor elasticity. The carbon fiber shaft has an excellent elasticity and a relatively poor torsional force. Generally speaking, the conventional golf club is not provided with an effective means to absorb shock. In addition, the conventional golf club has a smooth surface which does not provide a good grip. As a result, the grip portion of the conventional golf club is provided with a skidproof covering at an additional production cost.

SUMMARY OF THE INVENTION

The primary objective of the present invention is to provide a golf club shaft capable of alleviating shock and exhibiting resilience under torsion.

In keeping with the principle of the present invention, the foregoing objective of the present invention is attained by a golf club shaft which is formed of an upper segment of a fiber composite material and a lower segment of a metal material. The upper segment exhibits an excellent elasticity. The lower segment exhibits resilience under torsion.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
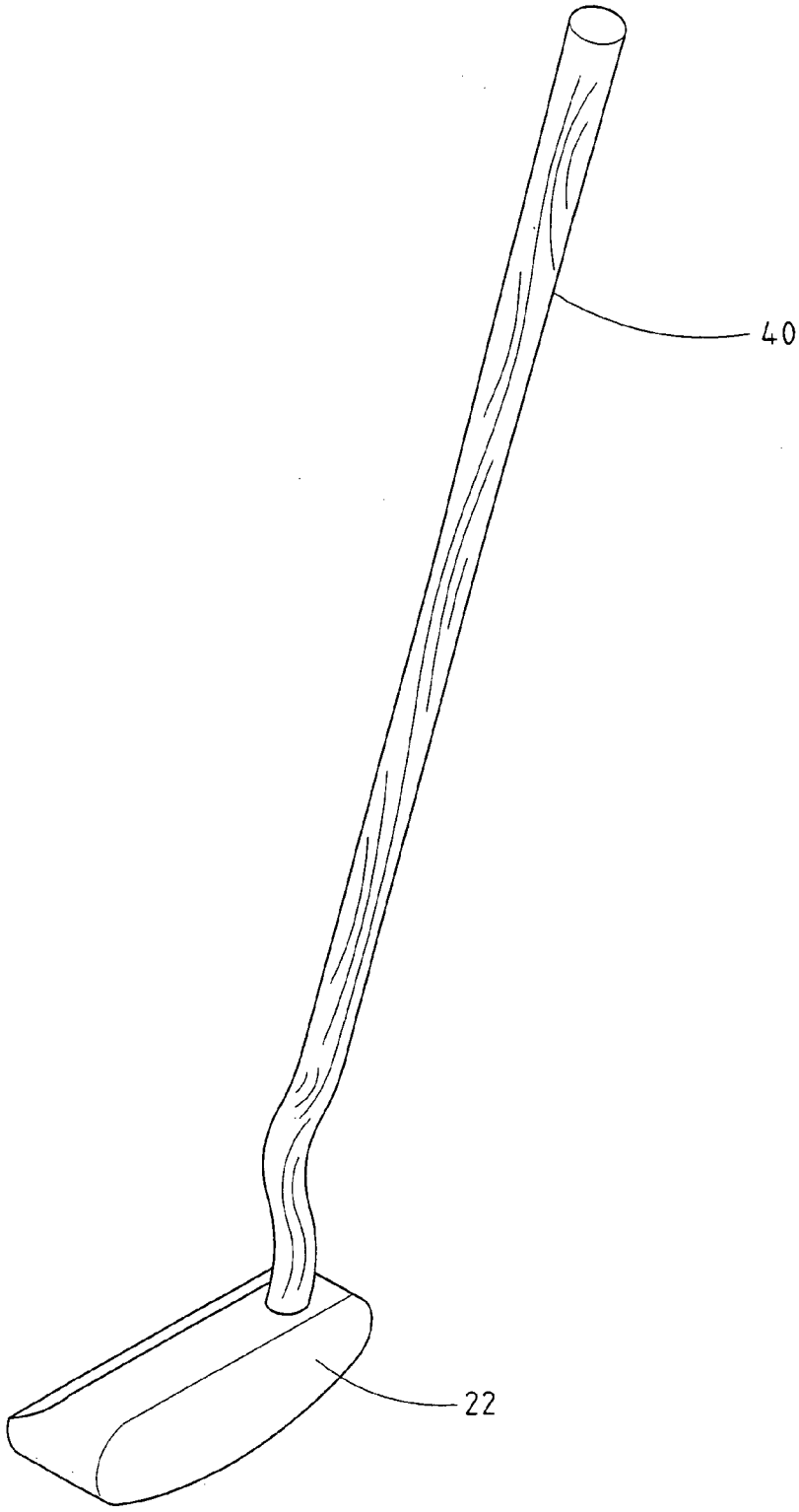
FIG. 1 shows a perspective view of the preferred embodiment of the present invention.
Figure 2:
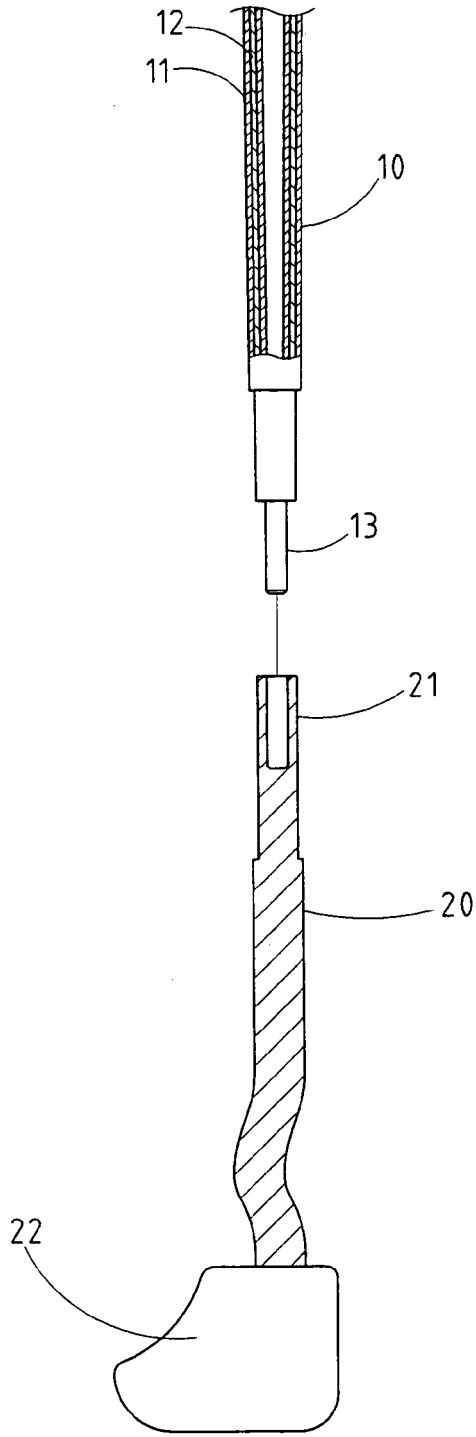
FIG. 2 shows an exploded view of the preferred embodiment of the present invention.
Figure 3:
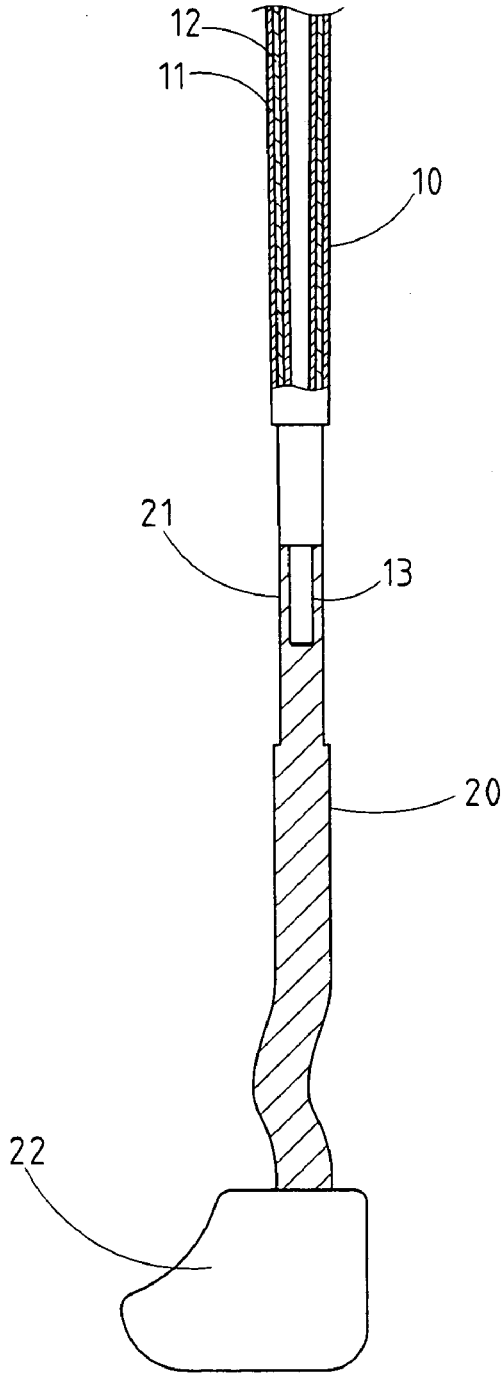
FIG. 3 shows a partial longitudinal sectional view of the preferred embodiment of the present invention in combination.
Figure 4:
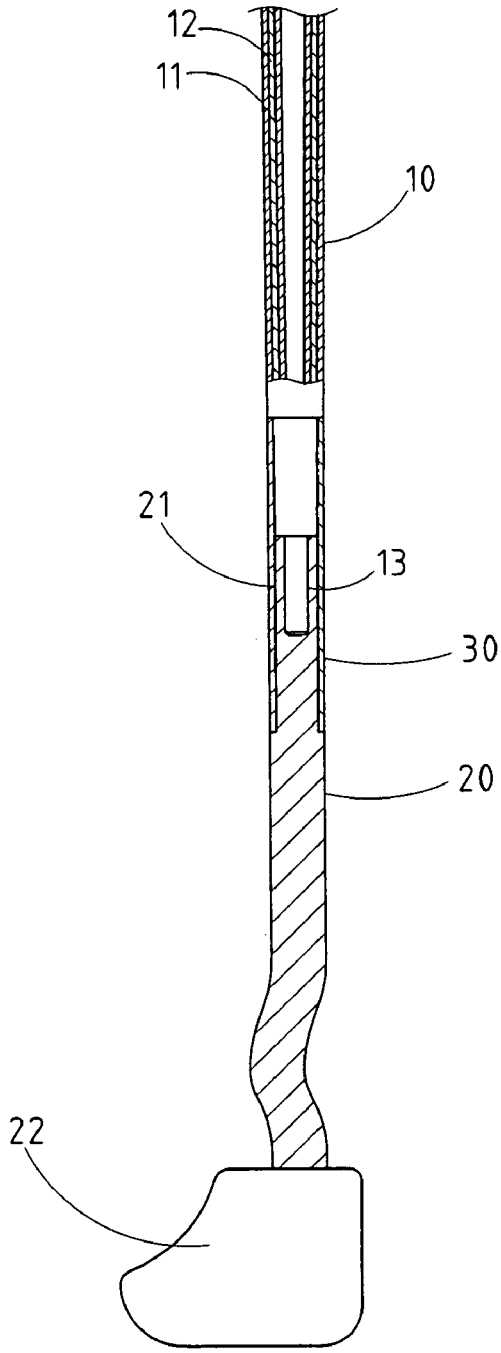
FIG. 4 shows another partial longitudinal sectional view of the preferred embodiment of the present invention in combination.
Figure 5:
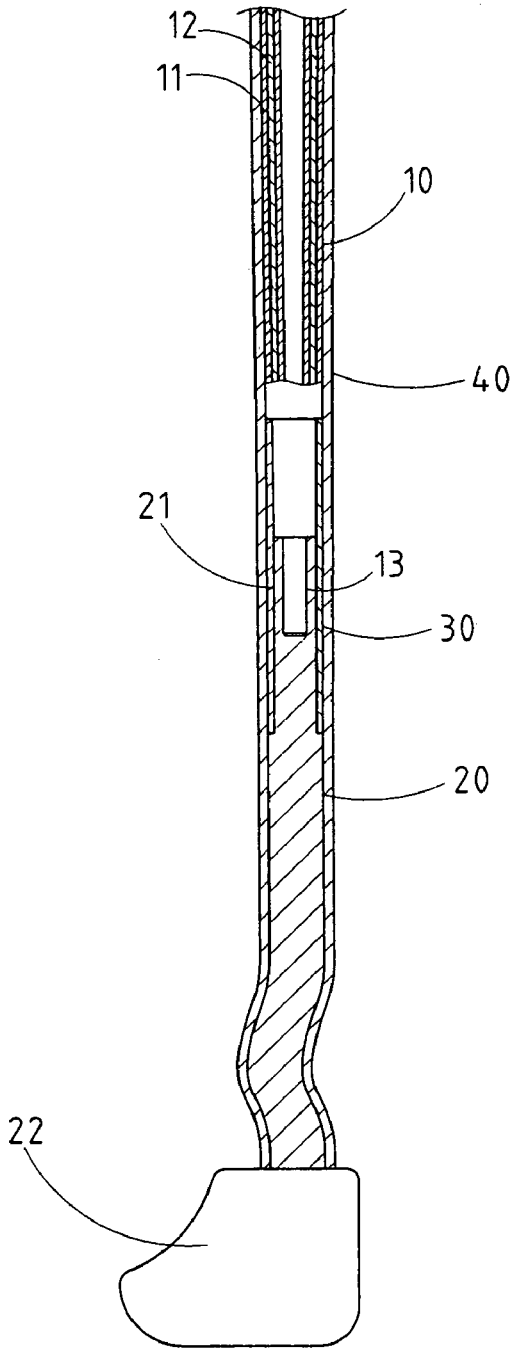
FIG. 5 shows a complete longitudinal sectional view of the preferred embodiment of the present invention in combination.

As shown in FIGS. 1–5, a golf club shaft embodied in the present invention comprises an upper segment 10, a lower segment 20, a joint cover 30 connecting the upper segment 10 and the lower segment 20, and a sheath 40.

The upper segment 10 is made of a plurality of fiber layers 11 and wood layers 12, which are intertwined.

The lower segment 20 is made of a metal material and is fastened at a bottom end with a head 22.

The joint cover 30 is used to cover a joint which is formed of a lower end 13 of the upper segment 10 and an upper end 21 of the lower segment 20. The joint cover 30 is used to reinforce the joint and is made of a carbon fiber material.

The sheath 40 is used to cover the upper segment 10, the lower segment 20, and the joint cover 30. The sheath 40 has an outer surface with wood grain. The sheath 40 may be made of a piece of wood or a plurality of wood pieces different in forms.

The upper segment 10 is made of a fiber composite material and is therefore provided with an excellent elasticity. The lower segment 20 is made of a metal material and is therefore capable of exhibiting resilience under torsion. The joint of the upper segment 10 and the lower segment 20 is reinforced by the joint cover 30 of a carbon fiber material. The upper segment 10, the lower segment 20, and the joint cover 30 are covered partially or entirely by a skidproof sheath 40 of a woody material. The wood-grained sheath 40 gives an added esthetic effect to the golf club shaft of the present invention. The upper segment 10 is provided with a shock-absorbing capability. The lower segment 20 is used to provide the golf club shaft of the present invention with an added strength.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A golf club shaft comprising:

an upper segment made of a plurality of fiber layers and woody layers intertwined with said fiber layers whereby said upper segment is provided at a bottom end with a connection portion;

a lower segment made of a metal material and provided at a top end with a connection portion;

a joint formed of said connection portion of the bottom end of said upper segment, said connection portion of the top end of said lower segment, and a cover of a composite material to reinforce said two connection portions; and a sheath made of a woody material for covering said upper segment, said lower segment, and said cover of said joint.

2. The golf club shaft as defined in claim 1, wherein said sheath is made of a woody sheet.

3. The golf club shaft as defined in claim 1, wherein said sheath is made of a plurality of woody sheets different in form.

4. The golf club shaft as defined in claim 1, wherein said cover of said joint is made of a carbon fiber composite material.

* * * * *